United States Patent [19]

Miller

[11] Patent Number: 4,869,508

[45] Date of Patent: Sep. 26, 1989

[54] GOLF CLUB HEAD

[76] Inventor: Wallace W. Miller, 161 Secor, Sequim, Wash. 98382

[21] Appl. No.: 217,715

[22] Filed: Jul. 11, 1988

[51] Int. Cl.[4] ..... A63B 53/04

[52] U.S. Cl. ..... 273/175; 273/167 E; 273/169

[58] Field of Search ..... 273/175, 167 E, 167 J, 273/172, 171, 170, 169, 167 F, 167 A

[56] References Cited

U.S. PATENT DOCUMENTS

| | | | |
|---|---|---|---|
| 780,776 | 1/1905 | Brown | 273/175 |
| 3,719,359 | 3/1973 | Evans et al. | 273/175 |

*Primary Examiner*—George J. Marlo

*Attorney, Agent, or Firm*—William I. Beach

[57] ABSTRACT

An improved golf club head for use in sand and water hazards present on golf courses. The club head contains an array of apertures disposed in vertical spaced relationship. The apertures provide ample opening through the head for passage of sand to materially reduce the resistance of sand or water thereon when striking a golf ball. The bottom of the club head includes a broad mass of material that has a slightly curved lower surface which extends laterally from a curved front edge to a curved rear edge that is wider and thicker than the top. The rear edge curve continues on upward and foreward whereby it merges into the rear face along a longitudinal line approximately ⅓ of the distance to the top surface. The upper surface of the mass slopes upward in a concave curve at a connection with the front face adjacent to the front edge to the rear face adjacent to the longitudinal line. The upward slope of the upper surface is at angle with the front edge that when the club head strikes the golf ball a large amount of sand is scooped up and passed through the apertures resulting in a reduction of sand drag and an increase in efficiency in lofting the ball up on the greens.

5 Claims, 1 Drawing Sheet

GOLF CLUB HEAD

FIELD OF THE INVENTION

The present invention relates to golf club heads that are adapted for use in lifting a golf ball out of sand traps, water basins and the like, and more particularly the type constructed to reduce resistance of sand and water on the passage of the club head to the golf ball.

DESCRIPTION OF THE PRIOR ART

Although the specific embodiment of the instant invention was not found in a novelty search several patents are cited herein that disclose golf clubs that suggests means for lightening the head or for use in sand and water hazards. Some have holes bored in the club head such as U.S. Pat. Nos. 873,423, 1,414,124 and 3,059,926. U.S. Pat. No. 780,776 shows a club head with slots or slots and holes. Canadian Pat. No. 642,134 discloses a club head with holes in the upper face portion and a relatively large longitudinal slot in the bottom portions. However, none show structure like the instant invention. From prior experiments working with various arrangements of holes and slots in a club head it was observed that covering the face with small holes had little or no useful effect in driving a golf ball out of a sand pit. Furthermore, while a limited number of large holes tend to reduce some frontal drag of sand or water on the club face the indentations on the face the impact on the golf ball tends also to reduce the direction of lift to the greens. Likewise, the same problem exists with vertical or horizontal slots. If slots are too many and narrow the effect on the club head is minimal since the acelerated movement of the head packs the sand in front of the slots so that very little sand passes through the slots. Under the same circumstance when the slots are too large the same problem occurs with the accuracy of lift of the golf ball to the greens. Accordingly the object of the instant invention is to provide a golf club which has the number of slots, dimensions, positions and optimum amount of openings for passage of sand or water therethrough to solve the above mentioned problems.

SUMMARY OF THE INVENTION

In carrying out the principles of the instant invention in accordance with a preferred embodiment thereof an improved oval like golf club head is of the type adapted for use in sand traps. The body includes a sloping front and rear face, top and bottom surface a rounded toe and heel. Connected to the heel is a hosel extending upwardly at an obtuse angle to the body for receiving a handle therein. The front and rear face extends downwardly and forewardly with respect to the handle.

The body has a longitudinal extending mass of material at the bottom that is wider and thicker than the top. The periphical outline of the mass is defined by a slightly curved lower surface extending laterally from a pointed and curved front edge to a curved rear edge. The rear edge curve continuing on upward and foreward merging into a longitudinal line along the rear face at approximately $\frac{1}{3}$ of the distance to the top surface. The upper surface of the mass forms a concave line sloping downward from a connection with the rear face adjacent to the longitudinal line to a connection with the front face adjacent to the front edge. Included in the body is a plurality of vertical apertures with front openings spaced uniformily from toe to heel of the golf club. The passages in the apertures stretch upward along the upper surface of the mass portion to exit out of the rear face openings adjacent to the longitudinal line. The passages are lined with a pair of spaced side walls connected at right angle at one end to the rounded, laterally extending top wall of the apertures and the other end to the rounded, laterally extending bottom wall, previously defined as the upper surface of the mass portion. The upper surface of the mass is set at an optimum angle with the front edge such that when the club head is about to strike the golf ball the packed sand on the front face is scooped up along the upper surface of said mass and passed through the rear face opening of the apertures into the sand pit, resulting in a reduction of sand drag for improved efficiency and accuracy in lofting the ball upon the greens.

DETAILED DESCRIPTION OF THE INSTANT INVENTION

Figure 1:
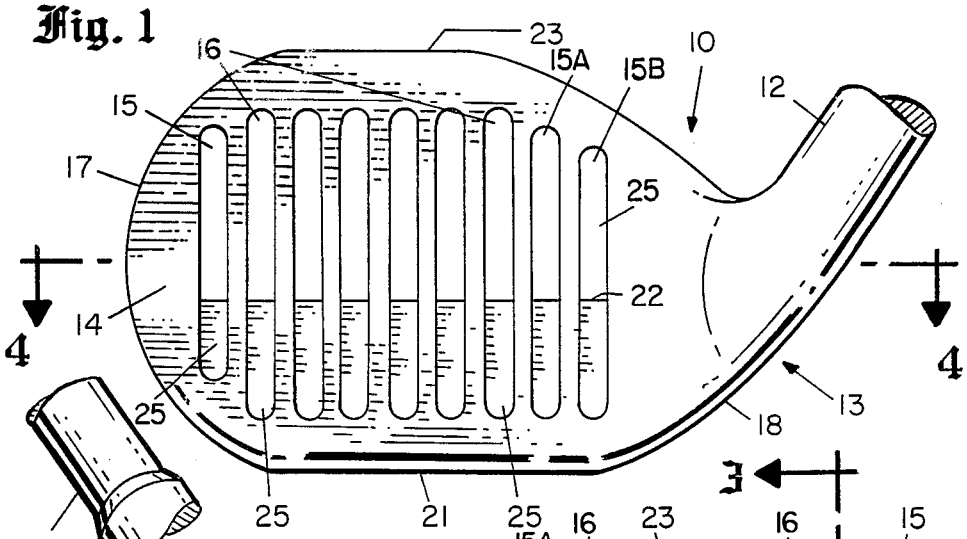
FIG. 1 is a front elevated view of a preferred embodiment of the instant invention showing an array of apertures in the face of a golf club head.
Figure 2:
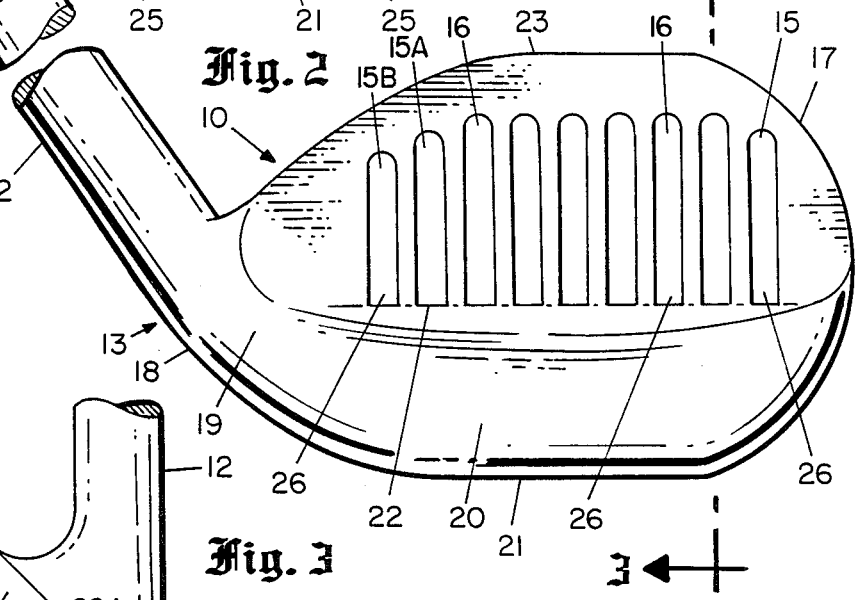
FIG. 2 is a rear elevated view of the golf club head of FIG. 1.
Figure 3:
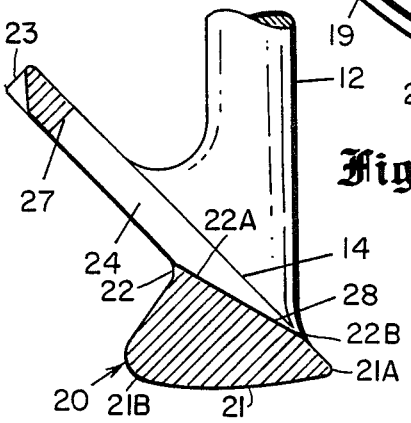
FIG. 3 is a sectional view taken along line 3—3 of FIG. 2.
Figure 4:
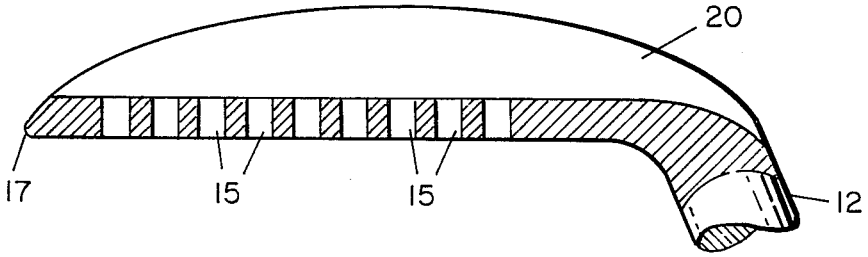
FIG. 4 is a horizontal sectional view taken along line 4—4 of FIG. 1

Referring to FIGS. 1–4 it can be seen that the golf club head has an oval-like body that contains an array of rectangular apertures disposed in spaced vertical relatinoship within the peripheral boundary of the golf club head. The apertures provide optimum means for allowing a considerable amount of sand blocking the path of the golf club head, through a body of sand to pass through the apertures. Subsequently more accuracy is obtained in under-cutting the golf ball and lifting it to the greens.

The golf club 10 includes a handle 11 that has the lower end inserted in a hosel 12 connected to a golf club head 13. The front face 14 is positioned with the impact surface slanting forewardly and downwardly at an obtuse angle with the hosel 12. The relationship between face 14 and handle 11 is arranged so that when the face is in position to undercut a golf ball for lift to the greens the handle is slanting upright between the legs of the golfer. The angle of approach of the face 14 to the golf ball is extremely important in perforating the head with openings for reducing sand drag on the club head. Preferably such openings or rectangular apertures 15 should be of size, numbers, position and shape for receiving an adequate amount of sand through the apertures to materially reduce the sand drag on the club head. The shape and size of the club head 13 indicated that 60% of the impact area could be opened up for the passage of sand through the apertures. Nine rectangular apertures are spread longitudinally over approximately 2-$\frac{1}{4}$ inches of the front face 14. The first aperture 15 adjacent to the toe 17 is approximately 1-$\frac{1}{4}$ inches long by $\frac{1}{8}$ inches wide. The next six apertures 16 in line are 1-$\frac{3}{4}$ inches long by $\frac{1}{8}$ inch wide. Following this are the eighth and ninth apertures 15A and 15B adjacent to the heel 18 which are 1-$\frac{1}{2}$ and 1-$\frac{1}{4}$ inches long respectively by $\frac{1}{8}$ inch wide. On the bottom portion of clubhead 13 is a broad mass of material extending longitudinally along the bottom which is wider and thicker than the top portion.

The peripheral outline of the mass includes a sightly curved lower surface 21 extending laterally from a relatively pointed curved front edge 21A to a larger curved rear edge 21B which continues on upward and foreward to merge into a longitudinal line 22 along rear face 19 that is approximately ⅓ of the distance to the top 23, and extending downward from the longitudinal line 22 the upper surface of mass 20 forms a concave line 22A which intersects the front face 14 at 21B adjacent to the front edge 21A. The interior passages through apertures 15, 15A, 15B and 16 are lined with spaced side walls 24 extending upward from the bottom of front face opening 25 to the rear face opening 26. The side walls 24 are connected at right angle to lateral extending top curved walls 27 and at the bottom curved walls 28, defined as the upper surface of mass 20 and a concave line 22A. The top and bottom walls are rounded to prevent the sand particles from jamming at square corners of the passages. The bottom wall 28 ascends rather steeply from the front face opening 25 to the rear face opening 26 adjacent to the longitudinal line 22. The ascending wall 28 is important in passing the passage of the optimum amount of sand through the club head. For example, when under-cutting the golf ball to lift it to the greens the path of the club head through the sand is relative short. During the short arc of the head in the sand the angle of the front face is such that the bottom wall of the passage is nearly parallel to the top level of the sand bed. Hence, the particles of sand can be scooped more readily through the aperatures.

I claim:

1. An improved golf club head of the type constructed for use in a sand trap having an oval-like sloping front and rear face, a top and bottom surface, a rounded toe and heel, the heel connected at an obtuse angle to an upright hosel adapted to receive a handle therein, the improvement comprising a golf club head with a large lateral extending mass at the bottom substantially wider and thicker than the top surface, the lower surface of the mass stretching from a pointed and curved front edge to a curved rear edge, the rear edge curve continuing on upward and foreward and merging into the rear face along a longitudinal line approximately ⅓ of the distance to the top, and the upper surface of said mass sloping downward in a concave curved line from a connection with the longitudinal line to a connection with the front face adjacent to the front edge thereby enclosing the peripheral boundary of said mass, and further including a plurality of uniformally spaced apertures extending longitudinally through the club head having passages leading upwardly along the upper surface of said mass, and the lower wall of the apertures, from said front face opening to exit out of said rear face openings along said longitudinal line, whereupon said rear face openings continuing on upward to an upper wall connecting the front and rear openings adjacent to the top of said club head, and whereby said club head at the point of striking a golf ball rotates the slope of said upper surface so that sand is scooped up and passed through said rear opening providing less drag and more accuracy in lofting the ball out of the sand trap.

2. A golf club head as recited in claim 1 wherein:

said apertures have rectangular passages including a width substantially less than the length.

3. An improved golf club head of the type designed for driving a golf ball out of a sand trap including an oval-like sloping front and rear face, a top and bottom surface, a rounded toe, a rounded heel connected at an obtuse angle to an upright hosel for receiving an elongated handle therein, the improvement comprising a golf club head including a relative large mass of material at the bottom, substantially wider and thicker than the top, with a lower surface extending laterally from a curved pointed front edge to a curved rear edge, whereby the curve continues upward and foreward closing with the rear face along a longitudinal line approimately ⅓ of the distance to said top, and an upper surface of the mass extending from a connection to said rear edge curve at the longitudinal line downward along a concave line to a connection at the front face adjacent to the front edge, and further including a plurality of vertical apertures extending longitudinally in uniformily spaced passages through the club head for receiving sand therethrough, the passages leading through openings in said front face stretch upward along the upper surface of said mass, thereby becoming the lower wall of the apertures, and exits out of openings in said rear face at the longitudinal line connection to said rear edge curve, said rear face openings extending on upward to an upper wall connecting said front and rear openings adjacent to the top, and whereby the club head prior to striking a golf ball rotates the slope of said upper surface such that said sand is scooped up and passed outward through said rear openings and thus providing less sand drag and more accuracy in lofting the ball upon the greens.

4. A golf club head as recited in claim 3, wherein: said passages are lined with parallel side walls spaced logitudinally having opposite end connected at right angle to laterally extending curved upper and lower end walls of said apertures.

5. A golf club as recited in claim 3, wherein:

said apertures comprise a middle group of uniform length, distal apertures adjacent said heel of lessor length than the middle group and a distal aperture adjacent to the toe of lessor length than the distal apertures adjacent to the heel.

* * * * *